US005585047A

United States Patent [19]

Mortensen et al.

[11] Patent Number: 5,585,047

[45] Date of Patent: Dec. 17, 1996

[54] VENTED FIRE RESISTANT WATER COOLING TOWER

[75] Inventors: Kenneth P. Mortensen, Bonner Springs; Ronald D. Forest, Olathe, both of Kans.; John W. Rellihan, Kansas City, Mo.

[73] Assignee: The Marley Cooling Tower Company, Mission, Kans.

[21] Appl. No.: 515,234

[22] Filed: Aug. 15, 1995

[51] Int. Cl.[6] ..... B01F 3/04

[52] U.S. Cl. ..... 261/109; 169/54; 169/57; 261/DIG. 11

[58] Field of Search ..... 169/54, 56, 57; 261/109, DIG. 11

[56] References Cited

U.S. PATENT DOCUMENTS

| | | | |
|---|---|---|---|
| 609,278 | 8/1898 | Kane | 169/56 |
| 2,783,845 | 3/1957 | Mathisen | 169/54 |
| 3,208,534 | 9/1965 | Kazarian | 169/54 |
| 3,246,432 | 4/1966 | Young, Jr. | 169/57 |
| 4,173,605 | 11/1979 | Long | 261/109 |
| 4,543,218 | 9/1985 | Bardo et al. | 261/DIG. 11 |
| 4,552,222 | 11/1985 | Goans et al. | 169/57 |
| 4,737,321 | 4/1988 | McCloskey et al. | 261/109 |
| 4,788,013 | 11/1988 | Kinney, Jr. et al. | 261/DIG. 11 |
| 4,947,736 | 8/1990 | Koning | 169/57 |
| 5,247,998 | 9/1993 | Fallon | 169/54 |

OTHER PUBLICATIONS

"Standard on Types of Building Construction", *ANSI/NFPA* 220, Feb. 10, 1992, pp. 220–225–220–228.

"Standard on Water Cooling Towers", *ANSI/NFPA* 214, Aug. 14, 1992, pp. 214–215–214–217.

Aligned Fiber Composites a Division of MMFG brochure, "Duradek–Fiberglass Walkway and Platform Systems", (no date) pp. 1–9.

The Marley Cooling Tower Company brochure, "Class F400 Fiberglass Composite Counterflow Cooling Towers", (no date).

*Primary Examiner*—Tim R. Miles

*Attorney, Agent, or Firm*—Hovey, Williams, Timmons & Collins

[57] ABSTRACT

A fire resistant industrial water cooling tower (20) is disclosed having normally closed passive vent structure (28) which vents the interior of the tower (20) above the area which is undergoing combustion to enhance suppression of the fire. The vent area is dependent upon the location and extent of the fire. The vent structure (28) comprises means presenting a series of vent openings which are closed by a component (88) that responds to flames and/or hot products of combustion to move out of blocking relationship to the opening thus venting the interior of the tower. In preferred embodiments, the vent includes a panel member (82) having a series of openings (83) therein which are either covered or blocked by a synthetic resin member (88) formed of a material which will burn and has a relatively low melt temperature thereby causing the material to either burn or rapidly melt when subjected to flames and/or hot products of combustion resulting from a fire in a part of the tower. The fire resistance of an industrial water cooling tower may be further enhanced by the utilization of fill assembly racks (52) made up of individual fill packs (50) that upon burning to a predetermined extent may fall away from the remaining packs of the stack to prevent lateral spread of the fire to the remainder of the fill assembly.

20 Claims, 7 Drawing Sheets

VENTED FIRE RESISTANT WATER COOLING TOWER

BACKGROUND OF THE INVENTION

1. Field of the Invention

This invention relates to industrial water cooling towers and particularly to towers of that class which are fire resistant. Novel passive vent means is provided for venting the interior of the tower when a fire occurs to enhance suppression of the combustion process.

2. Description of the Prior Art

Industrial sized water cooling towers have found extensive use in large industrial, business and multiple resident complexes because of their ability to efficiently dissipate large amounts of process or occupancy generated heat to the atmosphere. Cooling towers of this type are found in various areas including factory complexes, chemical processing plants such as petrochemical facilities, near offices, at hospitals, as a part of multi-family apartments or condominiums, as a part of large commercial retail properties, warehouses and electrical generating stations including nuclear power plants.

Cooling towers are constructed of any one of a number of materials including wood, fiberglass, concrete or steel structure, with plastic, wood or ceramic type fill materials. In many instances, uninterrupted operation of the tower is a critical factor because of the importance of continuity of the cooling system to overall process operation, and the particular function of the dependent operating system. The primary job of a cooling tower is generally the efficient cooling of water for processes or facilities. As a result, other design considerations are generally subordinate to the primary cooling function.

However, one usually subordinate design element that can become paramount under certain circumstances relates to fire safety. This is especially true if a tower fire has the potential of endangering personnel in a high occupancy area near the tower, or shut down of the tower because of a fire would adversely affect a process, a production facility or a utility such as a nuclear power plant. Because of these potential hazards, users, insurance carriers, contractors and fire authorities may mandate that the cooling tower be constructed of low combustion materials and of a fire retardant design, or otherwise protected against fire hazards with fire suppression systems such as water sprinklers.

The initial approach to low combustibility tower design was to use non-combustible structure and frame materials combined with a low efficiency, high cost, heavy brick or ceramic type fill, or no fill at all. However, the cost per unit of cooling of these designs was substantial and in most instances not an economically viable option. Later designs retained the non-combustible structures and frame materials previously used, but combined them with lighter weight and less expensive fire retardant fill material having low flame spread characteristics. Low combustibility materials alone however, did not guarantee fire safety.

Configuration and tower design details are critical to actual fire performance of a given model of a tower. Fill materials, although constructed of fire retardant materials, were usually not supported in configurations that substantially limited burning. More fire resistant fill configurations had to be created giving the overall design greater protection from fire damage and shut down. However, concrete and steel support structures were the only acceptable materials for use with the fire retardant fill configurations.

Tower designs which are the most economical and efficient generally have poor fire resistance. This is true of towers having wood frames and plastic fill. Douglas fir for example is an excellent construction material for most industrial cooling tower applications, providing longevity at a very economical price. Towers constructed of fir though are flammable and can completely burn down when exposed to a fire condition and the tower is not in operation. In certain circumstances, inability of the tower to meet fire protection specifications may rule the tower out for a particular application, or require installation of a fire protection sprinkler system which is not only expensive to install but also to maintain under varying ambient conditions. A secondary overall concern with wood towers is the environmental problems associated with leaching of preservative treatment chemicals. Preservatives are necessary to increase the longevity of the wooden cooling tower components under wet conditions.

Fire resistant towers are usually constructed of materials which are not self-propagating from a combustion standpoint. Conventional fire resistant components includes the structural components of the tower such as the upright support members, girts and the like, the fill assembly, the water distribution means overlying the fill assembly, and the casing and fan deck forming an enclosure for the tower.

Each material of construction has certain advantages and disadvantages. Among the factors involved are overall cost, combustibility of the particular material, corrosion resistance, and long term durability effecting longevity of the tower or suitability of the construction materials to a given end use. The ultimate goal would be to provide a cooling tower design which utilizes the highest efficiency components available, with the longest lasting materials of construction, and which cooperate to provide a required cooling function. Protection from material breakdown and strength loss as a result of metal corrosion or wood rot while offering protection from an external risk such as fire has been a long sought but not fully attainable goal. This has been particularly true from a cost benefit standpoint.

Cooling towers which are essentially unprotected from fire hazards, primarily those fabricated from wood, burn rapidly and completely when exposed to risk. Cooling tower fires in some instances may be impossible to extinguish via external fire fighting techniques and therefore require fire detection capable of detecting a combustion event and immediately initiating operation of a fire suppression system.

Fire suppression Systems such as sprinklers have been found to be generally reliable and serve well in several studies of fire incidents involving cooling towers. However, in order to be completely effective, more than one level of sprinklers are usually required on very tall tower configurations. However, sprinkler systems are very maintenance dependent insofar as corrosion is concerned and offer particularly difficult design considerations insofar assurance of water supply under freezing conditions.

Not only must the system provide rapid fire detection with low probability of false signaling, necessitating complex and costly detectors such as thermistors or the like. In addition, the water release mechanism must be positive and instantaneously responsive to fire detection. Sprinkler heads having melt out plugs have been employed, but squib actuated deluge valves are preferred because of their faster reaction time. Although these systems have proven to be effective as installed, they are expensive and extremely difficult to maintain on a regular basis over intervals of time that normally involves many years where there is no functional need for the system to operate.

Because sprinkler systems are expensive to install and require many specific care actions and programed maintenance, cooling tower users have sought to eliminate the need for such systems based on tower designs. These alternative design concepts have for the most part relied upon the use of non-combustible materials which are much more expensive than wood. Furthermore, the designs must meet customer acceptance standards and desirably comply with industry standards such as those receiving Factory Mutual (FM) approval, without the use of sprinkler protection. This entails not only structural protection in fires, but also limited combustion spread, especially laterally in the fill assembly, which represents the area of highest internal BTU content.

FM approval has typically been based on testing of tower mock ups for full tower sections for fire resistance. The FM approval process is based on placement of a very substantial ignitor in the lower part of the tower, and then observation of the effect of that ignition on the test cell or tower as a whole. A one foot by one foot plan area pan containing heptane to a depth of three inches is placed in the tower below the fill assembly and ignited. FM has not published specific judgment criteria, but instead issues approvals case by case based on test observations.

With the advent of synthetic resin framing components for cooling towers, as for example polyester resin reinforced with fiberglass, usually referred to as FRP or GRP, the provision of a fire resistant cooling tower which has required strength, durability and longevity characteristics, has become closer to reality. The use of FRP in the construction of cooling towers has slowly evolved over the years. Glass fiber reinforced synthetic resin components such as fan stacks, fan blades, fill support grids and wood tower braced diagonal connectors have been used for a number of years and have established FRP as a durable material in the corrosive cooling tower environment. In more recent years, virtually the entire components of a cooling tower have utilized FRP materials to provide effective corrosion resistance while retaining required structural strength. Exemplary is the "Four-way Crossflow Water Cooling Tower" of U.S. Pat. No. 4,788,013. Towers of the type disclosed in the '013 patent using alternative materials have become closer in cost to prior wood designs, particularly when the properties of cooling efficiency, superior corrosion resistance, long term longevity and overall maintenance and replacement costs are taken into account.

FRP cooling tower design interests have now focused on producing a low combustibility, low fire risk design in pultruded fiberglass structural material using high efficiency low flame spread fill materials such as polyvinyl chloride (PVC).

The assignee hereof has obtained a number of FM approvals on crossflow and counterflow cooling towers. These designs have been characterized by steel or concrete framing and PVC fill and eliminators in various configurations. Also approved have been fiberglass reinforced polyester fan blades, fan cylinders and distribution pipes along with PVC distribution piping and polypropylene type adaptors and nozzles. Approved tower sizes have ranged from relatively small towers, 4 feet by 4 feet by 6 feet to very large towers having a diameter as much as 400 hundred feet and a concrete shell 500 feet tall.

An FM approved tower incorporating a non-combustible ceramic tile fill is very inefficient in cooling capacity, is size limited based on fill weight, and is a very expensive design. A more recently approved tower design employs an extra cell for redundancy and an impenetrable fire barrier between each cell. The extra cell is required because a whole tower segment between any barrier location is subject to total fire exposure. Manifestly, provision of an extra cell protected by a fire barrier is a very expensive and therefore undesirable attempt to solve the fire hazard problem. PVC fill in a combustible support frame requires a substantial fire barrier and significant extra tower capacity. Burning cannot be controlled by design in any current FRP framed, PVC filled tower design.

A number of fire hazards exist in connection with cooling tower installations. The primary fire risks are associated with: 1) electrical equipment malfunctions and shorts, principally occurring in fan motors or junction boxes; 2) lightning strikes; 3) welding/cutting torch sparks from on or near the cooling tower; 4) sparks from an external source in the area such as an incinerator; and 5) careless storage of combustibles on, near or under the cooling tower, creating ignition sensitivity problems. Contrary to what would be expected, studies have shown that at least a third of cooling tower fires occur while the tower is in operation. The principle fire risk areas are the fan deck which is exposed to external sparks, and the fill assembly, because of its combustible nature and large BTU content in a limited internal area.

As a consequence, principle efforts to limit fire risks have heretofore for the most part been directed toward use of non-combustible materials, especially the fill components, and structural members, by configuration alternatives to limit fill combustion, by adding well maintained sprinkler systems with adequate water supply that is not subject to freeze up or corrosion, by adding lightning protection, by careful siting to avoid high risk locations, by specific management control of cutting and welding activities because of the high number of fires which result from these sorts of accidents, and by initiating emergency reaction readiness planning.

SUMMARY OF THE INVENTION

Although a cooling tower may be constructed of fire resistant materials, once a major fire has started within the tower, the fire resistant materials in effect may become combustible because of the rapid build up of heat that occurs within the interior of the tower. Towers in accordance with this invention have novel passive, normally closed air vents in the tower casing and/or fan deck which upon opening as a result of sensing of a fire serve to vent the interior of the tower to the atmosphere when a fire occurs inside of the tower thus enhancing suppression of the combustion process.

In the past, as noted, efforts to control fires in cooling towers have been directed to external protection such as sprinklers, or to the use of fire proof or fire retardant materials of construction. It has not been previously recognized that if a cooling tower is vented immediately adjacent the situs of a fire, the rapid release of hot products of combustion adjacent the fire site accompanied by flow of cool air from the surrounding atmosphere across the fire situs will actually function to suppress the fire and minimize lateral spreading. This is contrary to the conventional wisdom that there is a need to limit air access to the fire rather than increase the amount of air available.

In order to accomplish the intended purpose of suppressing the combustion process during a tower fire, the novel vent structure of this invention preferably includes means presenting apertures in the fan deck and/or the part of the upright tower casing where it joins the fan deck, and which are normally closed to prevent flow of air therethrough to preserve the air tight integrity of that part of the tower enclosure. However, the means normally closing the apertures comprises passive components which function to unblock the apertures when flame or the temperature within the tower adjacent thereto increases to a predetermined level thereby allowing air to flow outwardly to the atmosphere rapidly venting the area of the tower immediately above the high heat content fill assembly and serving to suppress a fire within the tower that has spread to the fill and adjacent structural components.

In one preferred embodiment, the normally closed vent structure of this invention comprises a fan deck made up of a series of fire resistant grates presenting a plurality of openings between adjacent grate members, and a layer of synthetic resin sheet material underlying the grates which is characterized by the property of melting or burning at a relatively low temperature so that when a fire occurs in a part of the tower, the hot products of combustion including the flame rising from such fire causes the sheet material immediately thereabove to melt or burn, thereby providing a vent opening for rapid relief of hot products of combustion through the vent opening thus presented.

An especially important aspect of the invention is the fact that the size of the vent provided is variable and directly dependant upon the extent of the fire within the tower. The greater the cross sectional area of the fire and corresponding area of the flame and/or hot products of combustion rising therefrom, the greater the size of the vent opening that is formed in the fan deck overlying the tower fill assembly. Limiting the vent opening to that required to vent hot products of combustion and/or flames assures the most efficient natural draft venting, while at the same time assuring that the vent opening that is formed is of adequate size under all circumstances, substantially regardless of the nature and extent of the fire.

Another important feature of the invention is the fact that by providing a normally closed grate defining vent as described which makes up the entire fan deck of the tower, a vented opening through the grate may take place in closest proximity to the fire, wherever the fire may occur across the plan area of the tower, thereby suppressing the fire and preventing its lateral spread throughout the fill assembly and associated structural members and fill support components.

In lieu of a grate-like vent normally closed by a readily meltable synthetic resin sheet laying against the inner face of the grate, panels may be provided having a series of openings therein which are closed by individual plugs fabricated of readily meltable, burnable or liquefiable synthetic resin material so that when a fire occurs at any point in the tower, the flame and/or hot products of combustion rising from such fire melt or burn the plugs immediately thereabove thus providing a series of vent openings immediately above the fire to assist in suppression of the fire and especially prevent its lateral spread across the plan area of the fill assembly.

Although a preferred embodiment involves a fan deck with normally closed vent structure, a further alternative construction consists of similarly functioning vents in the upright casing wall around the perimeter of the fan deck. A still further alternative arrangement comprises normally closed vent structure as described in the casing wall proximal to the fan deck, and in the fan deck as well.

Spring biased doors held in closed position across respective vent openings in the fan deck or uppermost part of the tower casing may be substituted for the synthetic sheet closed grates previously described. In this instance, temperature sensitive latches retain the doors in closed disposition until such time as the latches respond to flame and/or hot products of combustion thereby allowing respective doors to open under the spring bias thereagainst.

DETAILED DESCRIPTION OF THE PREFERRED EMBODIMENTS

Figure 1:
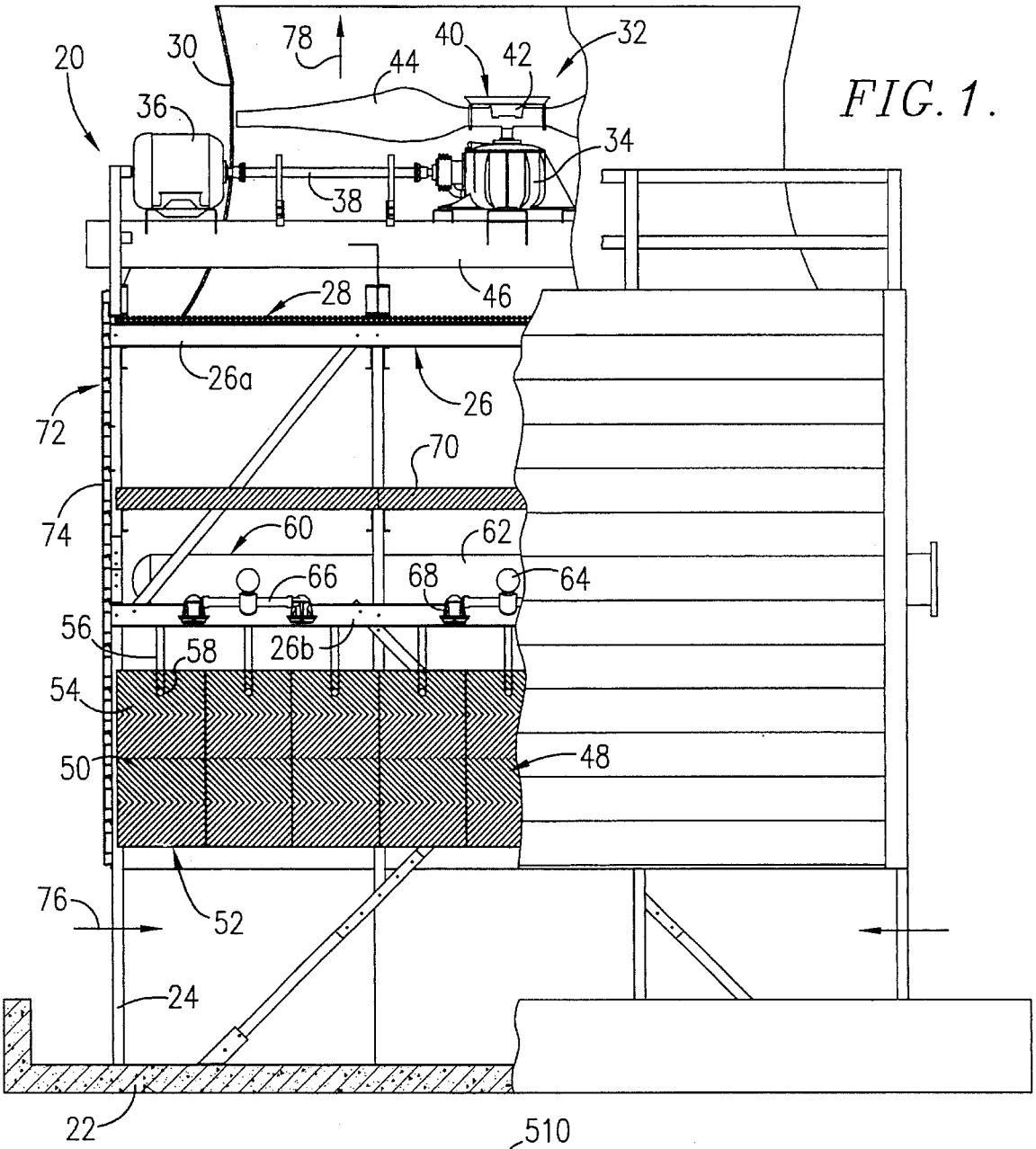
FIG. 1 is a side elevational view of a vented fire resistant induced draft counterflow water cooling tower, with parts thereof being broken away for clarity and illustrating a preferred embodiment of the normally closed vent structure in the fan deck of the tower, and with the fill assembly being suspended from support structure therefore.

A typical fire resistant vented counterflow water cooling tower embodying the preferred normally closed vent structure of this invention is designated by the numeral 20 in the drawings. The tower 20 includes a conventional concrete cold water basin 22 and a series of structural upright supports 24 and girts 26 which are fabricated of a fire resistant material such as FRP. A series of upper cross girts 26*a* support a fan deck 28 which embodies the vent structure of this invention. The fan stack 30 above deck 28 is likewise constructed of a fire resistant material, as for example FRP. The fan assembly 32 of tower 20 includes a gearbox 34 mounted centrally of stack 30 and driven by a motor 36 connected to the gearbox 34 by a shaft 38. The fan 40 has a central hub 42 joined to gearbox 34, and a plurality of radially extending fan blades 44 projecting from hub 42. The fan assembly 32 is carried by torque tube assembly 46 at the upper part of tower 20 which are in turn are supported by the main structural supports 24 of the tower. Fan stack 30 and fan blades 44 are preferably constructed of FRP. The hub 42, gearbox 34, shaft 38, motor 36 and torque tube assembly 46 are usually constructed of metal and therefore are fire resistant.

A fill assembly 48 within tower 20 is preferably comprised of a series of upright, side-by-side, interengaging fill packs 50 which make up a plurality of fill racks 52. Each fill pack has a plurality of upright, side-by-side interengaging PVC sheets 54 which are molded to present an undulating serpentine pattern as schematically shown in FIG. 1. Because of the undulating configuration of the serpentine pattern presenting alternating peaks and valleys in the surface of each of the sheets 54, air passages are presented between adjacent fill sheets to allow flow of air thereacross.

Each of the fill racks 52 is supported by at least two upright, horizontally spaced and aligned hangers 56 of stainless steel or the like and which and which are suspended from cross girts 26*b*. The hangers 56 associated with each pack 50 carry horizontal stainless steel tubes 58 at the lower ends thereof. The tubes 58 extend through the upper part of a corresponding pack 50. Tubes 58 thereby serve to support each of the fill packs 50 in upright disposition adjacent to a corresponding pack 50 and in interengagement therewith.

PVC is a preferred material for construction of the sheets 54 of packs 50 because it is a high efficiency low flame spread synthetic resin material, and has a sufficiently high melting point to substantially resist deformation at the hot water temperatures encountered in the fill of a water cooling tower.

Hot water distribution means 60 overlying fill assembly 48 includes a main manifold pipe 62, and a series of transverse cross distributors 64 joined thereto, which in turn have a plurality of nozzle pipes 66 provided with distributor nozzles 68 on the outermost extremities thereof. The manifold pipes 62 are connected to a main supply pipe through one or more risers either joined directly to pipe 62, or to a common horizontal connector conduit. Manifold pipe 62 is usually fabricated of FRP, while distributor 64 may be of FRP or PVC, and nozzle pipes 66 and nozzles 68 may be constructed of polypropylene.

Eliminators 70 directly overlying hot water distribution means 60 preferably consists of a series of PVC sheets which are also corrugated to present a series of inclined passages that cause the air flowing therethrough to be diverted from its normal upright path to drop droplets of water to be extracted from the hot air stream.

Casing 72 of tower 20 may be fabricated of a number of pultruded glass fiber reinforced polyester panels 74 of the type described in detail in an application for United States Letters Patent, filed by the assignee hereof on Jun. 6, 1995, Ser. No. 470,762, entitled "Multiple Purpose Panel For Cooling Towers", and which is incorporated herein by specific reference thereto. The panels 74 making up casing 72 around the perimeter of the tower terminate in spaced relationship from cold water basin 22 on at least one side of tower 20 thereby presenting an air entrance 76 below fill assembly 48. Stack 30 receiving fan assembly 32 defines a hot air outlet 78 above the fill assembly 48.

As a consequence, during operation of the tower, ambient air drawn into the tower 20 by the fan 40 through the air entrance 76 from the surrounding atmosphere moves upwardly through fill assembly 48 in counterflow relationship to water gravitating downwardly through the fill assembly 48 which has been delivered onto the top of the fill racks 52 from the hot water distribution means 60. Under cold ambient conditions, natural draft cooling takes place without operation of the fan 48. Therefore, water temperature is monitored to determine when and for what period of time fan assembly 38 is actuated.

Figure 4:
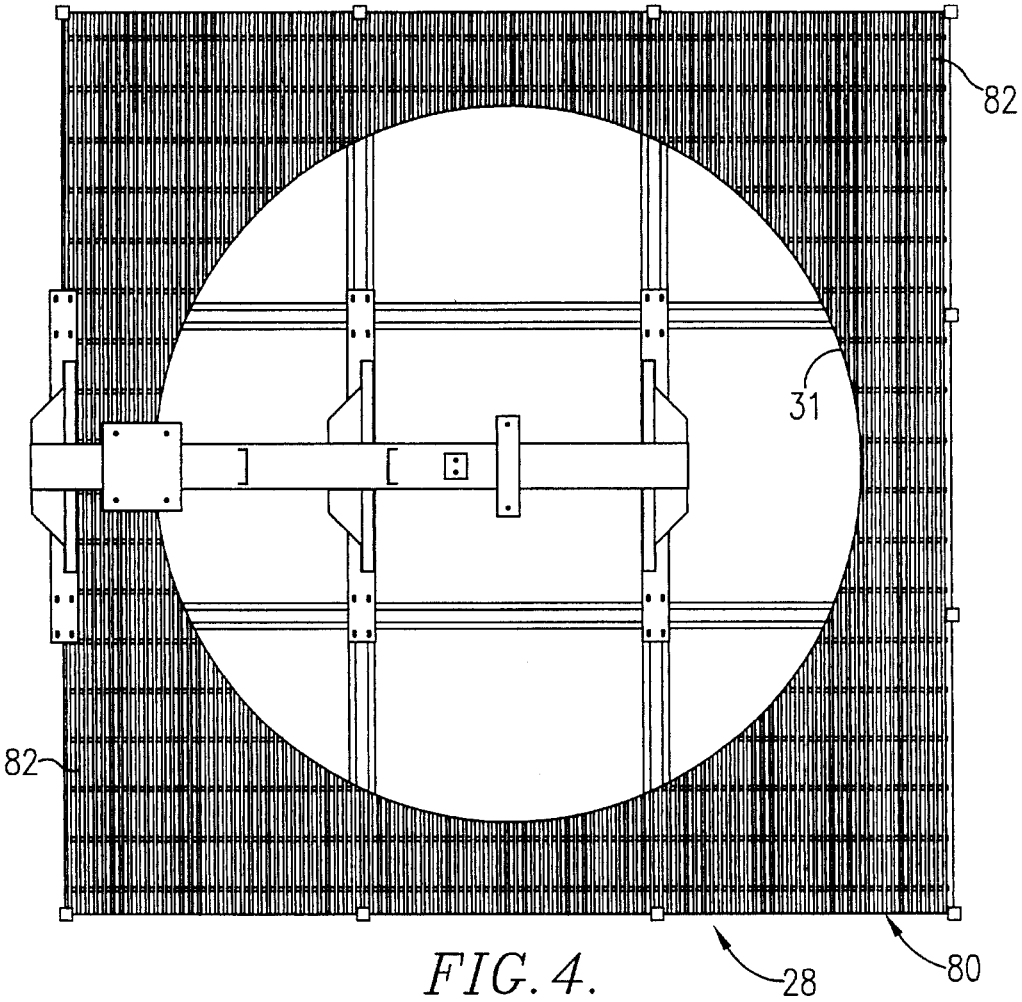
FIG. 4 is an essentially schematic plan view representation of a water cooling tower illustrated in FIGS. 1 and 2, and showing the preferred vented fan deck construction of this invention.
Figure 5:
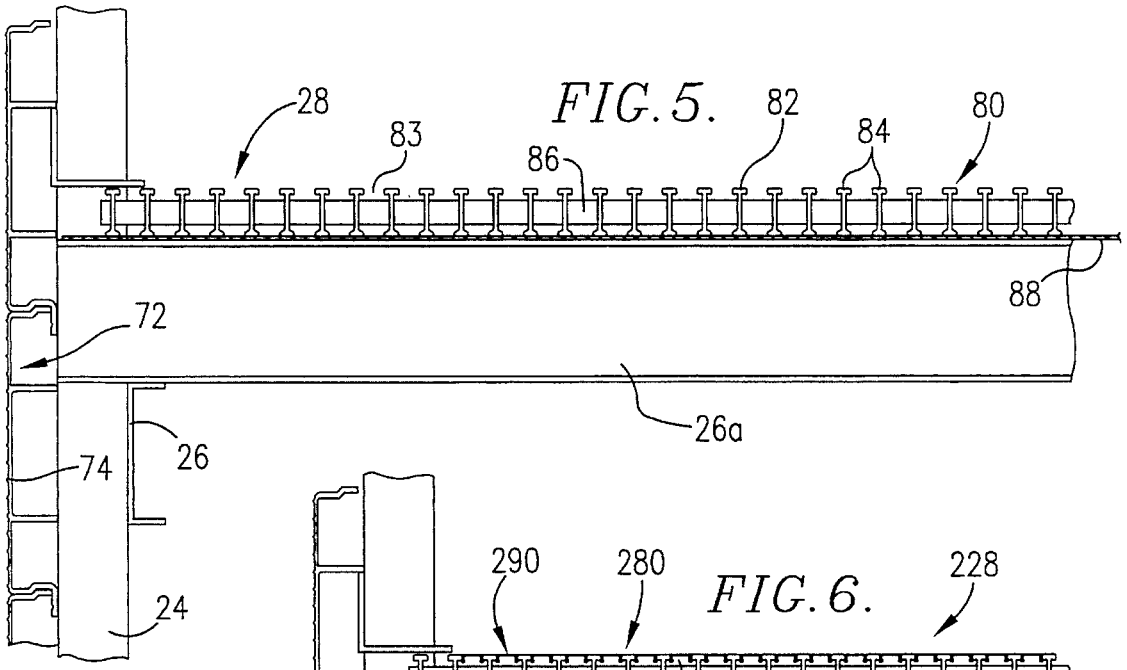
FIG. 5 is a fragmentary, enlarged, essentially schematic cross sectional representation of a preferred normally closed vent structure in the fan deck of a water cooling tower as shown in FIGS. 1 and 2 and comprising a grate-like deck with a relatively low melting temperature synthetic resin sheet underlying the grate and normally closing off the openings therethrough.

Viewing FIGS. 4 and 5, it is to be observed that fan deck 28 comprises a grate unit 80 preferably made up of a series of side-by-side grate panels 82 which define the fan deck which surrounds opening 31 at the bottom of fan stack 30. Preferred grate panels 82 are available from the Aligned Fiber Composites Division of Morrison Molded Fiberglass Company, Bristol, Virginia, and sold under the trademark DURADEK gratings. The preferred grate panel 82 is designated DURADEK Series I-6000 1½". This grate panel is fabricated of a fire retardant vinyl ester and has a 60% open area wherein the width of each open space 83 is 0.9 inch and the width of the top flange of each grate member 84 is 0.6 inch. Each grate member 84 is of transversely I-shaped configuration as shown in FIG. 5 with the individual members 84 being joined and held in the predetermined spaced relationship by a series of cross ties 86 also constructed of fire resistant vinyl ester material and positioned on 12 inch centers. The preferred DURADEK grate panels are available in panel widths of from 6 inches to 60 inches and lengths up to 240 inches.

The width of the grate members 84 preferably is from about ¼ to ¾ inch, and the spacing between the bars is preferably from about ½ to 1½ inches. The thickness of the grate panels preferably is from about 1 inch to about 2 inches.

One or more sheets of synthetic resin sheet material 88 is provided in underlying, full covering relationship to the underside of fan deck 28 made up of grate panels 82. Sheet 88 is of a synthetic resin having a relatively low melt temperature, with polyethylene, polypropylene, nylon and polyvinyl chloride being suitable materials. A preferred sheet 88 is fabricated of 6 mil nylon. An alternative sheet may be polyethylene which may or may not be reinforced with nylon mesh. Without such reinforcement, the polyethylene sheet should be from about 40 to about 100 mils; with nylon mesh reinforcement the polyethylene sheet should be from about 5 to 20 mils. Means, not shown, may be provided for securing the sheet 88 to the underside of grate unit 80 if desired.

In the operation of tower 20, if a fire occurs, the most vulnerable part of the tower is fill assembly 48 because of its high BTU content. In most instances, the fire initially is confined to a part of the tower and to a portion of the fill assembly 48. As the fill sheets 54 of a particular fill pack are consumed by the fire, the flames rising therefrom burn the area of sheet 88 immediately thereabove, or the products of combustion rising from the fire contact and then collect below that area of sheet 88 until the material melts. Because of the relatively low melting point of the sheet material (polyethylene 98° to 115° C., polypropylene 160° to 175° C., nylon-type polyamide 210° to 220° C. and PVC 75° to 105° C.), the part of the sheet 88 exposed to the flame or hot products of combustion from the fire burns or melts the material thereby unblocking the open area of the grate panels thereabove to vent the interior of the tower so that the hot products of combustion may rapidly escape to the surrounding atmosphere.

Of particular note is the fact that the area of the fan deck 28 which vents is variable and directly dependent upon the extent of the fire and the cross sectional area of the flame or hot products of combustion that rise upwardly to the underside of the fan deck. Similarly, the location of the vented area is also directly dependent upon the location of the fire therebelow. Confinement of the venting to that part of the plan area of the tower where the fire has occurred has the added advantage of assuring most efficient natural draft of air past the tower portion subjected to combustion, and provides the most efficient venting.

Although relatively low melting temperature synthetic resin materials as described are preferred for blocking the openings through grate unit 82, it is to be understood that the blocking material may be of characteristics such that it burns when exposed to flames or softens to an extent that when subjected to hot products of combustion from a fire, the gravitational pull or the air pressure thereagainst within the tower casing may displace the synthetic resin material away from the openings normally blocked thereby, thus providing venting of the interior of the tower.

Tests have established that contrary to expectation, venting of the upper part of the tower enclosure when a fire occurs has the effect of more rapidly suppressing the fire, and especially preventing lateral propagation of the combustion, than is the case without such venting. In addition, the use of a fill assembly made up of a series of side-by-side fill packs which are in interengagement but not joined one to the other provides another advantage in increasing the fire resistance of the overall tower 20. Upon occurrence of a fire, which as indicated generally starts in one part of the plan area of the tower, the fill sheets 54 of a particular fill pack are the first that are subjected to the fire and generally are the ones that are first consumed, at least to a certain extent by the flames of the fire. When a fill pack has been consumed by the fire to an extent that it is no longer supported by the hangers 56 and tubes 58, that fill pack 50 falls away from assembly 48 into the underlying cold water basin 20. In this respect therefore, it is preferred that each of the fill packs 50 be made up of individual sheets 54 that extend the full height of the fill assembly 48.

A preferred fill pack 50 fabricated of PVC sheets may for example be 12 inches wide, 24 inches deep and from 24 inches to 72 inches high. The overall fill rack 52 made up of fill packs 50 nominally constitutes a 6 feet by 6 feet bay pack.

Figure 2:
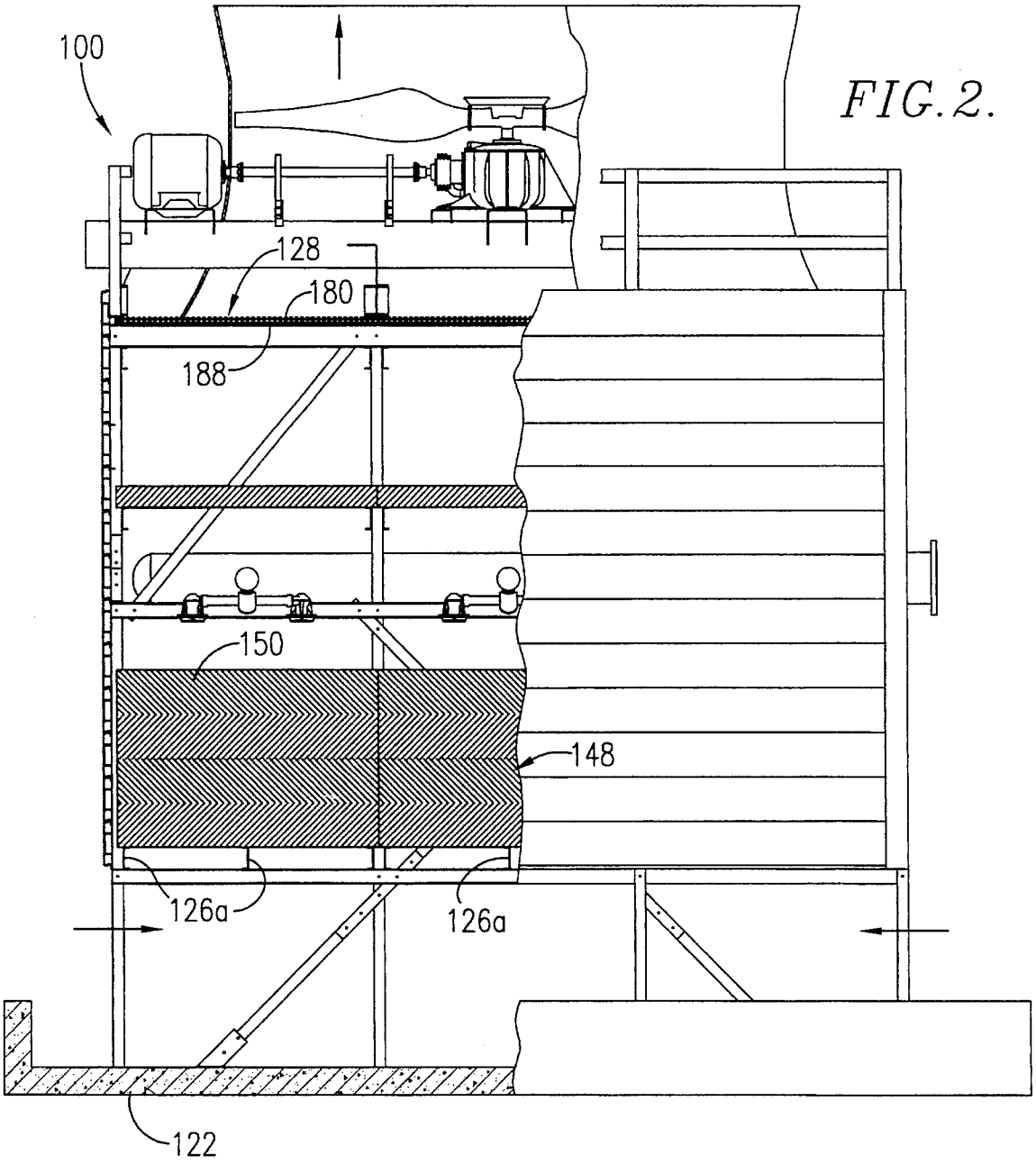
FIG. 2 is a side elevational view of a vented fire resistant induced draft counterflow water cooling tower similar to the tower of FIG. 1 but illustrating a fill assembly which is supported by structural members therebelow.

The tower 100 illustrated in FIG. 2 is the same as tower 20 except in this instance the fill assembly 148 rests on and is carried by the underlying girts **126*a* rather than being suspended from hangers 56 as depicted in FIG. 1. Although the individual fill packs 150 may fall away and gravitate into the cold water basin 122 in the same manner as described in respect to tower 20, the girt supports 126*a* for packs 150 require that the packs 150 be consumed by the fire to a greater extent than is the case with packs 50. For that reason, suspension of the fill assembly packs from hangers as shown in FIG. 1 is preferred over the bottom support construction of FIG. 2**.

Venting of the tower 100 provided by grated deck 128 is the same as that described with respect to the vented deck 28. Thus, a sheet 188 of the same type of synthetic resin material as described with respect to sheet 88 is provided in underlying relationship to the grate unit 180.

Figure 7:
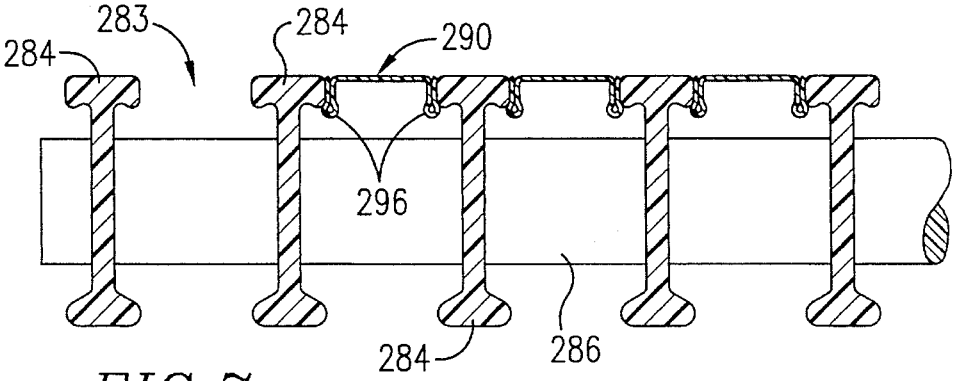
FIG. 7 is an enlarged cross sectional view of FIG. 6 to better illustrate the details of construction of the vent structure shown in FIG. 6.
Figure 8:
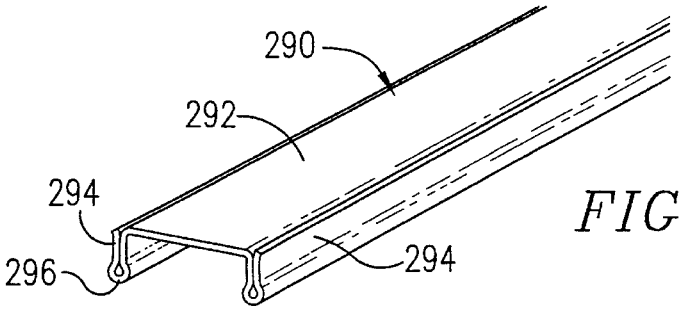
FIG. 8 is a fragmentary perspective view of one of the strips shown in FIGS. 6 and 7.
Figure 6:
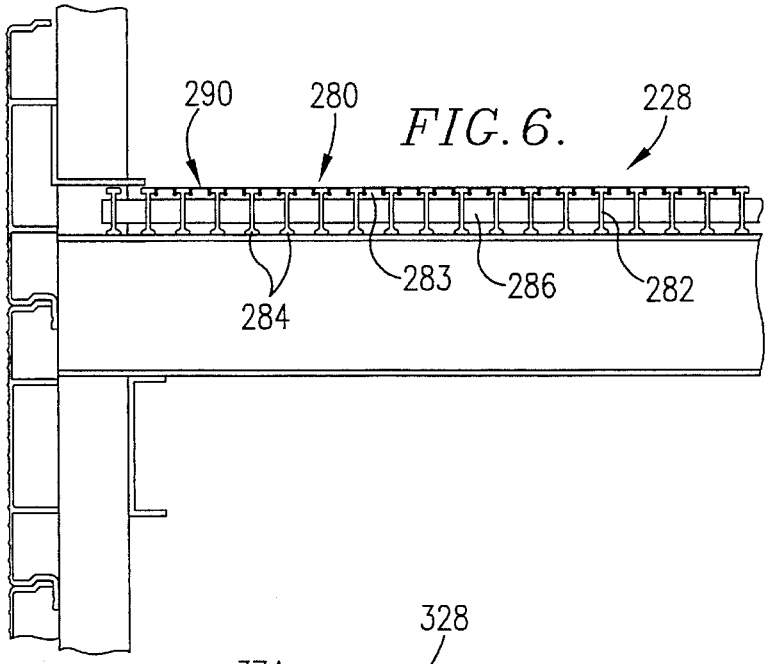
FIG. 6 is a schematic view similar to FIG. 5 and showing an alternative embodiment of the vent structure wherein the openings in the grate-like deck are normally closed by a series of relatively low melting temperature synthetic resin strips in place of an underlying synthetic resin sheet.

In the alternate embodiment of the normally closed vent structure for a vented fire resistant cooling tower as shown in FIG. 6, the fan deck 228 is made up of a grate unit 280 identical to grate unit 80. The grate panels 282 of grate unit 280 are also held in spaced side-by-side relationship by a series of cross ties 286. In this instance though, rather than providing an underlying layer of synthetic resin material such as sheet 88, each of the openings 283 between adjacent I-members 284 of grate panels 282 is closed with a strip 290 best illustrated in FIGS. 7 and 8. As is apparent from those latter Figures, the strip 290 has a central body portion 292 integral with depending rebent leg portions 294 which present an enlarged rib 296. The effective transverse width of each of the leg portions 294 is correlated with the transverse thickness of the flanges of grate members 284 so that the ribs snap into place between adjacent members 284 and are frictionally held therebetween (see FIG. 7).

The strips 290 are also preferably fabricated of a relatively low melt temperature synthetic resin material such as the materials described for use in fabrication for sheet 88. Thus, when strips 290 are subject to flames and/or hot products of combustion rising within the interior of the tower above the fill assembly, that portion of each of the strips 290 which is burned or heated to its melting temperature, melts or burns away thus unblocking the openings 283 between adjacent members 284 and providing for venting of the interior of the tower.

Figure 9:
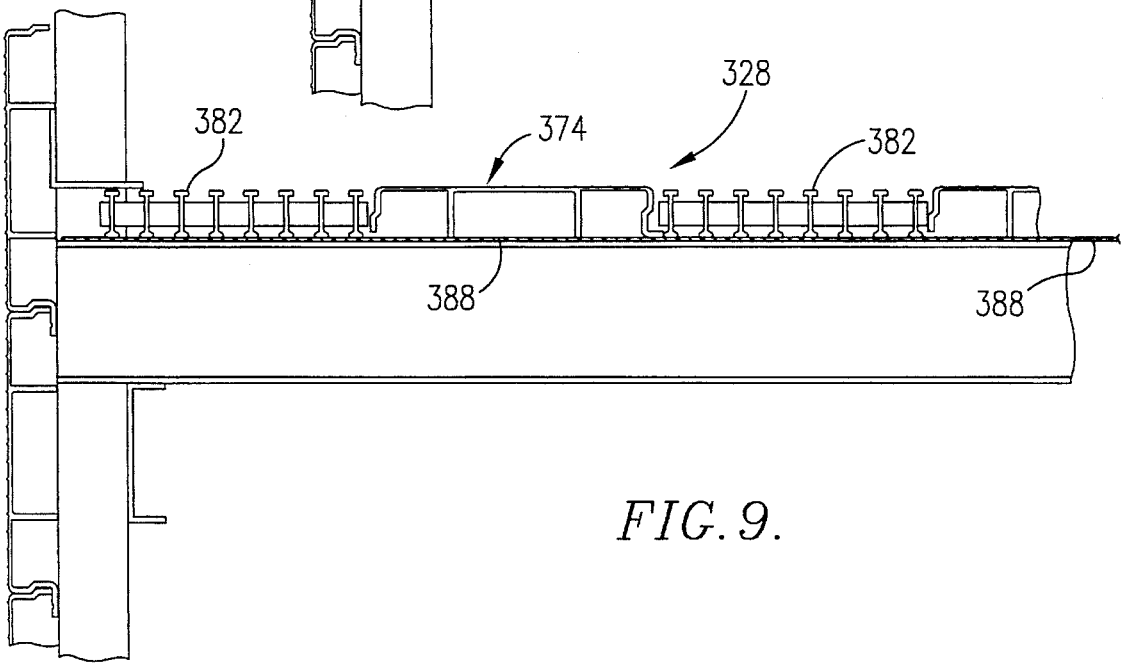
FIG. 9 is a fragmentary, enlarged, essentially schematic cross sectional representation of an alternative embodiment of the vent structure shown in FIG. 5 and embodying a series of grate-like members interrupted by a plurality of panel members defining a part of the fan deck of the tower, and with a relatively low melting temperature synthetic resin sheet being positioned below each of the grate-like members to normally prevent flow of air therethrough.

The fan deck 328 embodiment of FIG. 9 differs from the preferred fan deck embodiment shown in FIG. 5 in that the grate panels 382, which are identical to the grate panels 82 of grate unit 80, are in horizontally spaced relationship and are separated by respective panels 374 of identical construction to the panels 74 used to fabricate casing 72. A synthetic resin sheet 388 underlies the grate panels 382, and alternatively, if desired, the panels 374 as well. Although the fan deck construction 28 is preferred as indicated, because that venting arrangement provides the maximum amount of venting available for the entire plan area of the tower, the fan deck 328 embodiment of FIG. 9 offers somewhat more positive support for personnel walking across the fan deck of the tower.

Figure 10:
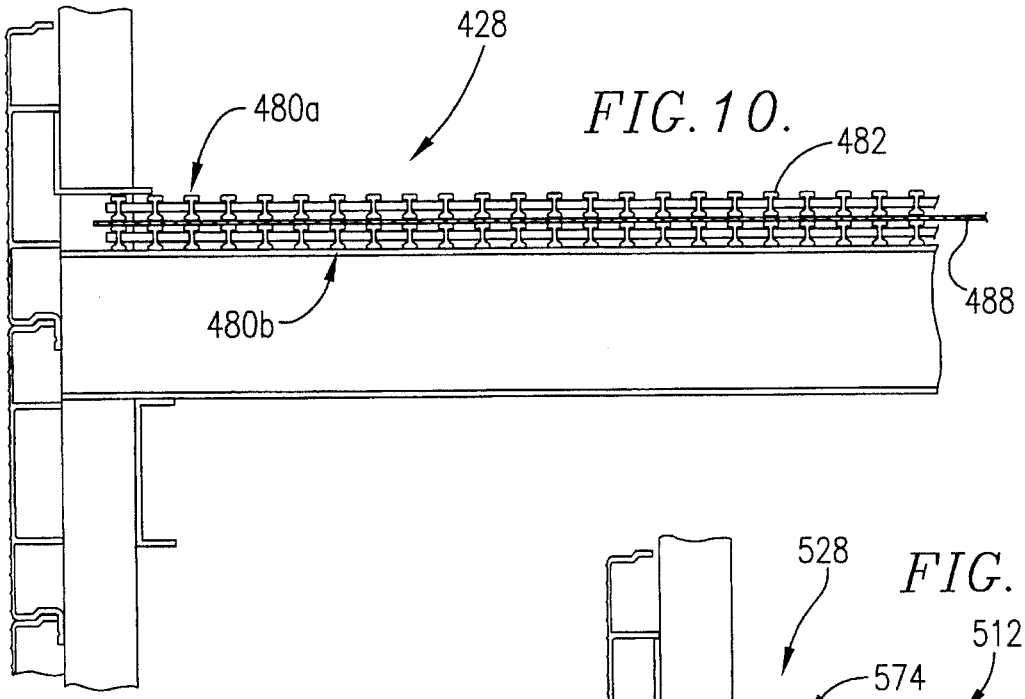
FIG. 10 is a fragmentary, enlarged, essentially schematic cross sectional representation of an embodiment of the vent structure hereof similar to that of FIG. 5 but in this instance comprising two layers of grate-like members one above the other, with the relatively low melting temperature synthetic resin sheet being interposed between the two layers of grate-like members.

The fan deck embodiment 428 shown in FIG. 10 differs from that of the FIG. 5 embodiment by the provision of two grate units 480*a* and 480*b* located in superimposed relationship one above the other. The individual grate panels 482 making up units 480*a* and 480*b* may be of the same thickness as grate panels 80, or they may be of lesser thickness as indicated in FIG. 10. The synthetic resin sheet 488, constructed of the same material used for construction of sheet 88, is located between grate units 480*a* and 480*b*. Venting provided by the deck of FIG. 10 is the same as described with respect to vented deck 28.

Figure 12:
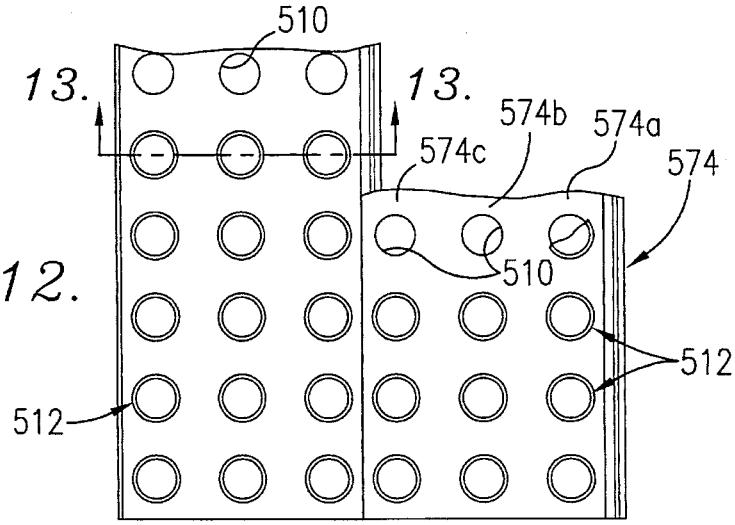
FIG. 12 is a fragmentary, enlarged, essentially schematic cross sectional plan view of the panel vent construction shown in FIG. 11.
Figure 13:
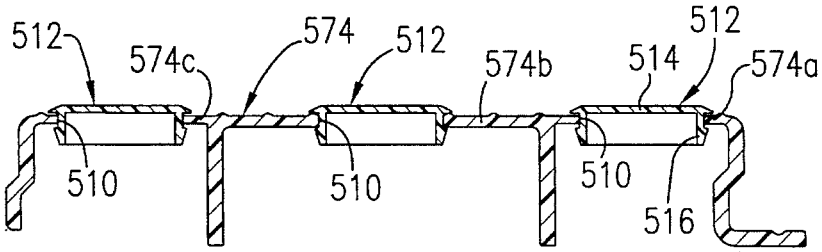
FIG. 13 is a fragmentary, enlarged, essentially schematic cross sectional view taken along the line 13–13 of FIG. 12 and looking in the direction of the arrows.
Figure 11:
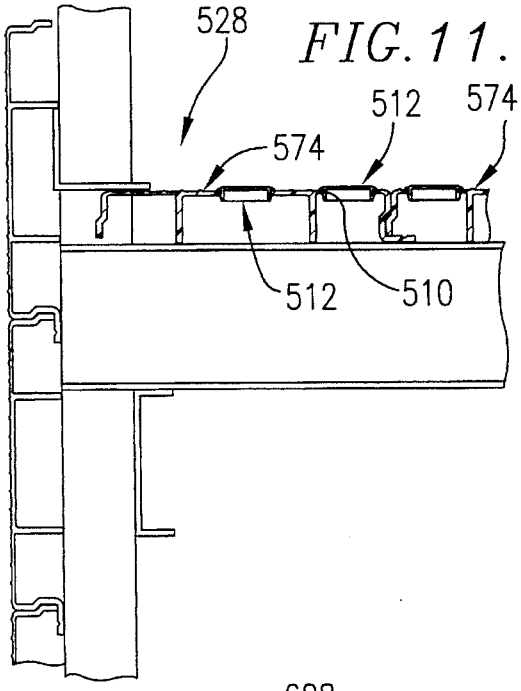
FIG. 11 is a fragmentary, enlarged, essentially schematic cross sectional representation of another embodiment of the vent structure of this invention wherein the deck is made up of a series of panel members each having a plurality of openings therein normally closed by plugs made up of a relatively low melting temperature synthetic resin material.

In FIG. 11, the fan deck embodiment 528 depicted is made up of a series of side-by-side panels 574 which are identical to the panels 74 of FIG. 1, except in this instance the planer portions 574*a*, 574*b* and 574*c* of each panel 574 is provided with a series of spaced openings 510 (FIGS. 12 and 13) which are normally closed by respective synthetic resin plugs 512. Each of the plugs 512 is fabricated of a low melt temperature synthetic resin of the type described with respect to the material used for fabrication of sheet 88. Plugs 512 preferably have a flat top 514 integral with a circular side wall 516 presenting a circumscribing external groove so that the plugs may be inserted into respective openings 510 where they remain locked in place. Upon initiation of a fire within the interior of a tower protected by a vented deck of the type designated by the numeral 528, plugs 512 subjected to flames and/or hot products of combustion from the fire burn and/or melt thereby unblocking respective openings 510 and allowing venting of the tower in the area where the plugs have melted and liquefied. Although not illustrated, it is to be understood that the plugged panels 574 may alternate with unplugged panels 74 in the same manner as described with respect to fan deck 328 and illustrated in FIG. 9.

Figure 14:
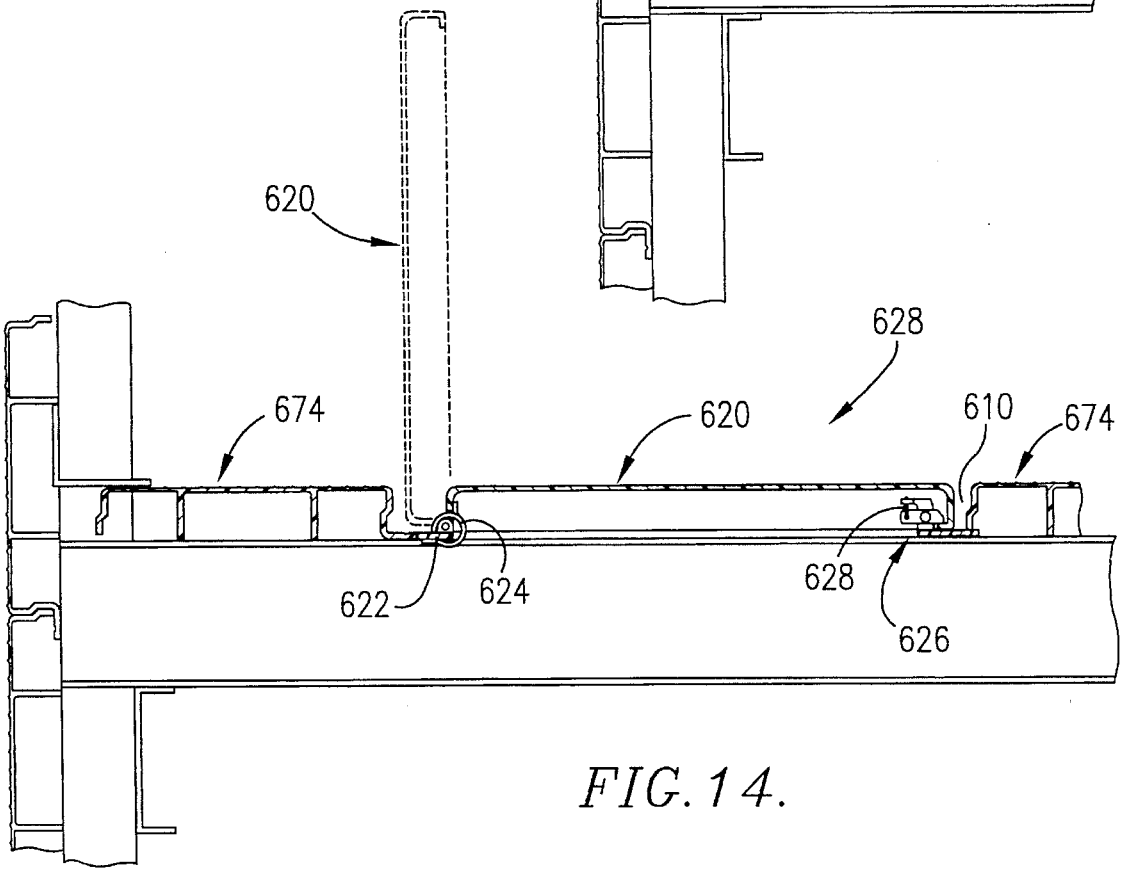
FIG. 14 is a fragmentary, enlarged, essentially schematic cross sectional representation of a further embodiment of the vent structure of this invention made up of a series of panels presenting the fan deck of a cooling tower, with at least certain of the panels being provided with vent openings therein, each normally closed by a spring biased door held in closed position by a hot products of combustion activated latch.

The vented fan deck 628 of FIG. 14 is another alternate embodiment of the invention wherein the panels 674 identical to panels 74 of tower 20 are in spaced relationship presenting an elongated opening 610 therebetween. Each of the openings 610 is normally closed by a door 620 pivotal about a respective pivot support 622 and normally biased into the open position thereof illustrated by the dotted lines of FIG. 14 by spring means such as torsion springs 624. A thermally activated latch assembly 626 associated with each door 620 functions to maintain a respective door 620 in the closed position of the same against the bias of spring 624. Flames and/or hot products of combustion contacting latch 626 ultimately cause the link 628 to melt or vaporize thereby releasing the latching engagement of door 620 with the latch assembly 626 and allowing such door to swing upwardly under the spring bias thereon to the open position thereof. The link 628 preferably is of a material such that it will fuse and melt or vaporize at a temperature approximately the same as the melting temperature of the synthetic resin material used to fabricate sheet 88.

Figure 15:
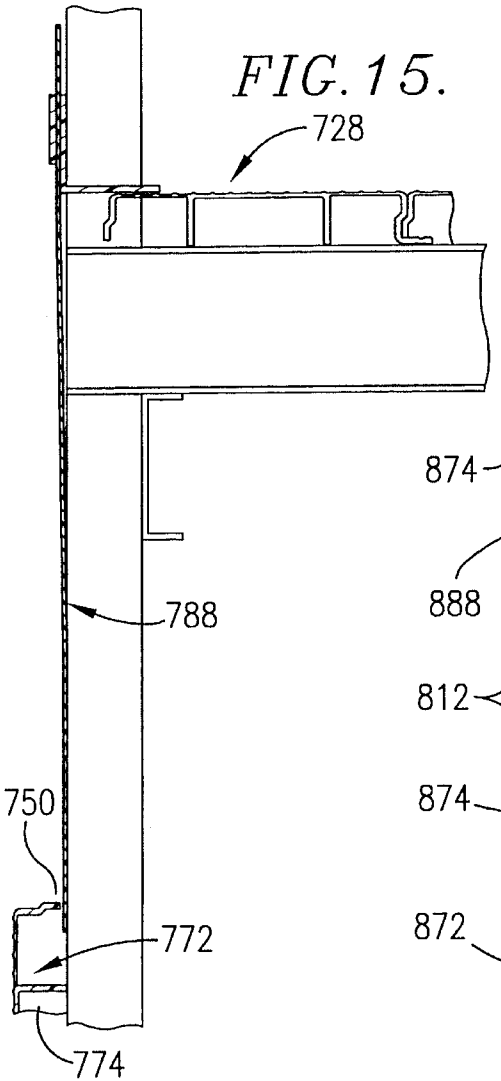
FIG. 15 is a fragmentary, enlarged, essentially schematic cross sectional representation of another embodiment of the invention wherein openings in the tower casing wall adjacent the fan deck of a cooling tower are closed by synthetic resin panels fabricated of a relatively low melting temperature synthetic resin material, thereby presenting normally closed vents openable by hot products of combustion thereagainst.

The alternate embodiment of the vent structure shown in FIG. 15 provides venting of the casing of the tower adjacent the perimeter of the tower fan deck. Thus, the casing 772 made up of panels 774 which are of the same construction as panels 74, terminates in spaced relationship from the overlying fan deck 728 to present a perimeter opening 750. A synthetic resin sheet 788 which closes opening 750 is constructed of the same type of resin material used to fabricate cover 88, but in this instance may be of somewhat greater cross sectional thickness than sheet 88 in order to withstand the air pressure thereagainst. Operation of the vent structure shown in FIG. 15 is the same as with other embodiments of the invention.

Figure 17:
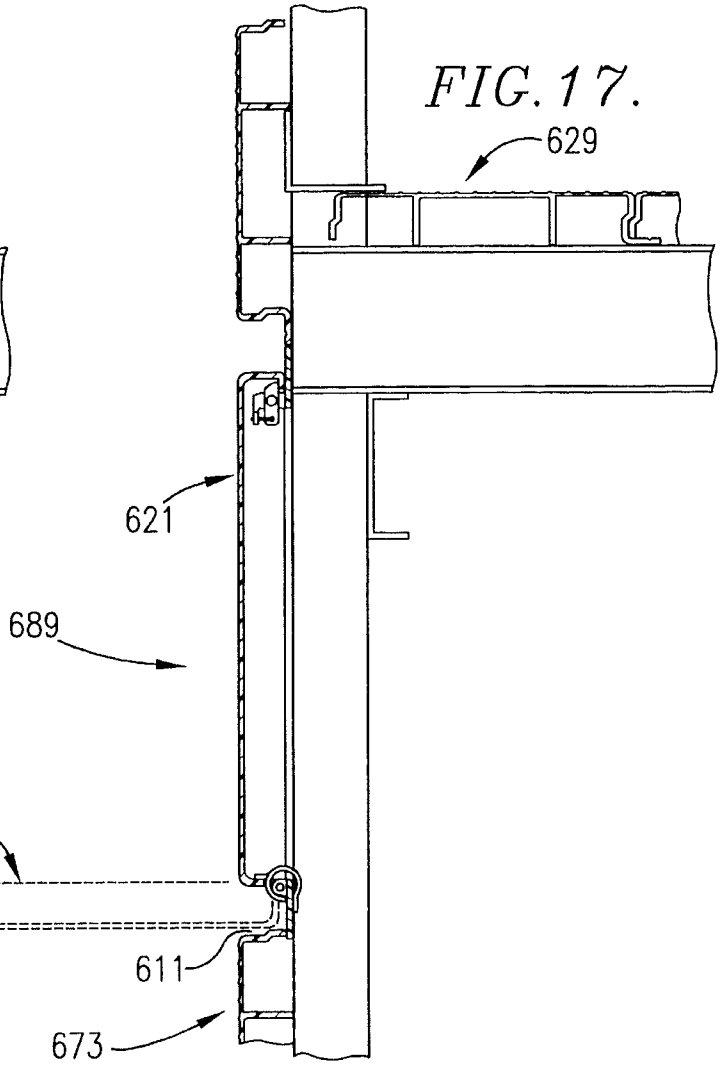
FIG. 17 is a fragmentary, enlarged, essentially schematic cross sectional representation of vent doors in the upper part of the tower casing and which are similar in construction and operation to the vent doors depicted in FIG. 14.
Figure 16:
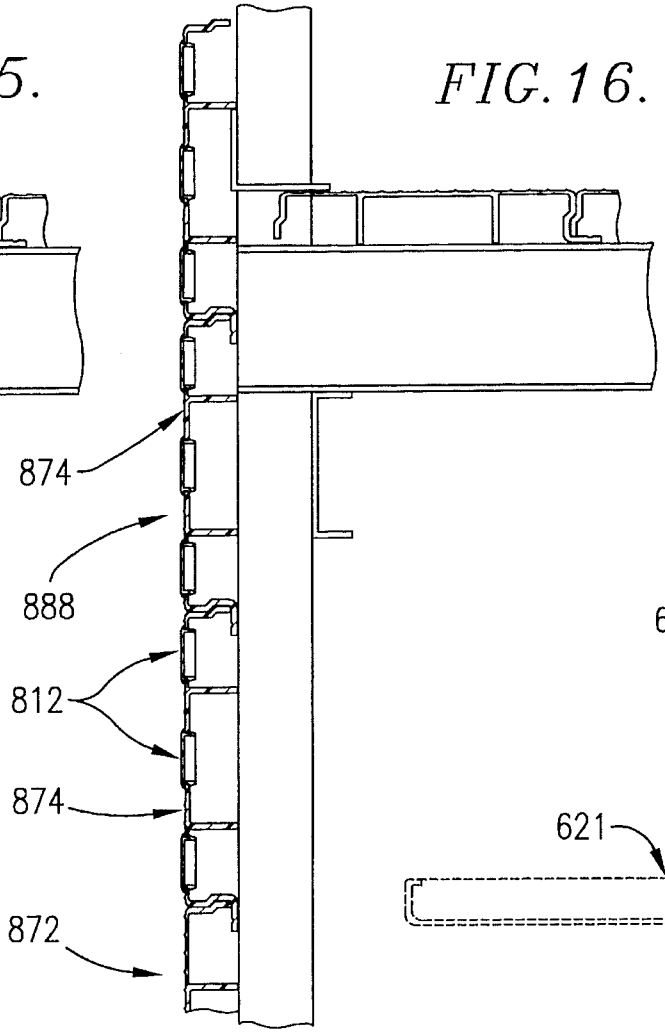
FIG. 16 is a fragmentary, enlarged, essentially schematic cross sectional representation which has panels in the upper part of the tower casing adjacent the fan deck also provided with a series of openings therein normally closed by plugs, and essentially conforming to the configuration and construction of the panels and plugs of FIGS. 12 and 13.

The vent structure embodiments 888 and 689 of FIGS. 16 and 17 respectively are the same as the vent structures 528 of FIG. 11 and 628 of FIG. 14, except that the vents of FIGS. 16 and 17 are in the uppermost part of casing 872 and 673 rather than in the fan deck. The vent 888 therefore has a series of panels 874 identical to apertured panels 574, and a plurality of readily meltable plugs 812 identical to plugs 512.

In like manner, the vent 689 has normally closed, spring biased doors 621 which are identical in construction and operation to doors 620 of FIG. 14. The only difference is the location of doors 621 in openings 611 in the upper part of casing 673, rather than in openings in the fan deck 629. Again, operation of latched doors 621 is identical to the operation previously described with respect to doors 620.

Figure 3:
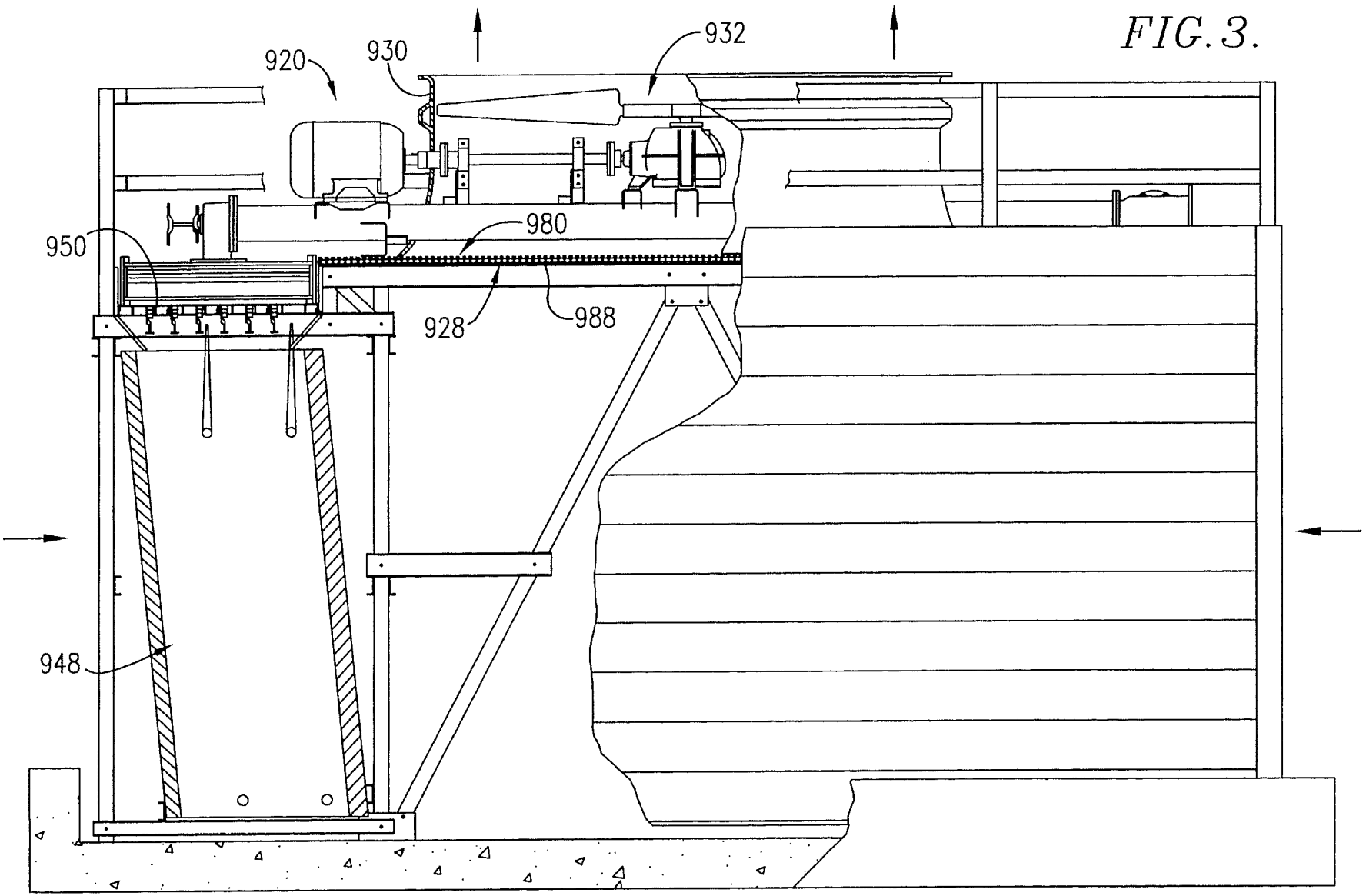
FIG. 3 is a side elevational view of a vented fire resistant induced draft crossflow water cooling tower, with parts thereof being broken away for clarity, and embodying the preferred normally closed vent structure in the fan deck of the tower.

The induced draft crossflow cooling tower 920 shown in FIG. 3 of the drawings is of conventional construction except for the provision of a vented fan deck 928 of identical construction and operation to the vented fan deck 28 of tower 20. The fill assembly 948 of crossflow tower 920 may either comprise individual, side-by-side fill sheets, fill packs similar to the fill packs of tower 20, or in the alternative may be a series of horizontally and vertically spaced splash bars of conventional construction and operation. It is preferred that the components of tower 920 be constructed of the same fire retardant materials previously described in detail with respect to tower 20. In the case of splash bars, these bars are also preferably fabricated of a synthetic resin material having fire retardant properties, such as PVC. Although hot products of combustion rise vertically from a fire within the fill assembly 948 of tower 920, the overlying hot water distribution deck 950 of the tower serves as a barrier thus diverting the flames and/or hot gases toward the fan deck 928, particularly when the fan assembly 932 is functioning. It is to be understood in this respect that the grated fan deck 928 as depicted in FIG. 3 has a central opening similar to opening 31 at the lower end of the fan stack 930. Thus, all plan areas of the fan deck 928 are capable of undergoing venting upon melting of a portion of the relatively low melting temperature synthetic resin sheet material 988 underlying grate unit 980.

The materials of construction for the components of a vented fire resistant cooling tower as described herein preferably have a flame spread rating no greater than about 25 under NFPA test standard 255, or ASTM E84. Materials meeting these standards are defined as limited-combustible under NFPA standard 220.

Burn tests using FM standards (1'×1'×3" deep heptane ignitor) comparing a commercial Marley Class F400 cooling tower (fiberglass composite counterflow cooling tower as depicted in FIG. 1) but without venting, and then an F400 with venting as described and depicted herein, established that the tower without venting burned to the ground, whereas with venting as shown in FIG. 1, only 12% of the available plan area of the tower was damaged. The damage that did occur was confined to the area directly above the ignitor. An approximately 10% maximum fire loss results in a tower that can readily be repaired at reasonable costs. This is especially true in view of the fact for the most part replacement of casing components adjacent to the fire area is all that is required, along with replacement of only those fill packs subjected to the fire, and proximal structural members.

The essential element of the present invention is the fact that the vent structure hereof controls the spread of combustion inside of the tower by limiting heat build up, and minimal damage occurs to the fill assembly because of the way in which a damaged fill pack may fall away from the remainder of the stack into the underlying cold water basin, before there has been any significant lateral profligation of the flame.

We claim:

1. In a fire resistant industrial water cooling tower having a cold water basin, hot water distribution means above the basin, structural components supporting a fill assembly within the interior of the tower between the hot water distribution means and the basin, casing and fan deck members carried by the structural components located in disposition to cooperatively define an enclosure for the tower having side walls and a top wall with a cold air entrance on one side of the fill assembly and a hot air outlet through the top wall on another side of the fill assembly, and fan means carried by the structural components for pulling cold ambient air into the interior of the tower through the air entrance and for discharging heated air from the fill assembly back into the atmosphere, said structural components, the fill assembly, and the enclosure defining members being fabricated of fire resistant material, the combination with said enclosure members of normally closed air vent structure which includes:

means presenting an aperture in an enclosure defining member above the fill assembly for passage of air therethrough from the interior of the tower to the surrounding atmosphere; and means for normally blocking passage of air through said aperture, said air blocking means being sensitive to flames and a predetermined increase in the temperature within the tower adjacent the aperture means resulting from a fire within the interior of the tower to open the blocking means thereby unblocking the passage and allowing air from the atmosphere to flow through the air entrance, through the interior of the enclosure and the fill assembly, and thence outwardly through said aperture to the surrounding atmosphere to enhance suppression of a fire that occurs within the interior of the tower.

2. A water cooling tower as set forth in claim 1, wherein at least one of said enclosure defining members is provided with a plurality of spaced openings therein presenting said apertures, and a synthetic resin plug disposed in each of the openings for blocking air flow therethrough, each of said plugs being of a synthetic resin material which will burn and at least soften to a point at said predetermined temperature allowing respective heated plugs to deform and thereby be ejected from said at least one of said enclosure members.

3. A water cooling tower as set forth in claim 1, wherein at least one of said enclosure defining members is provided with a plurality of spaced openings therein presenting said apertures, and a synthetic resin plug disposed in each of the openings for blocking air flow therethrough, each of said plugs being of a synthetic resin material which will burn and substantially liquefy at said predetermined temperature to unblock the opening normally closed thereby.

4. A water cooling tower as set forth in claim 1, wherein at least one of said enclosure defining members is made up of a plurality of panel elements, at least certain of which are provided with spaced openings therein, and said air blocking means includes a moveable door normally blocking the flow of air through a respective opening, and means operably associated with each of the doors for opening a respective door to allow air flow through the opening normally closed thereby when the temperature of the air adjacent a corresponding panel undergoes said predetermined increase.

5. A water cooling tower as set forth in claim 1, wherein substantially the entire area of the fan deck is defined by said fan deck enclosure members, said fan deck members comprising a series of elongated, side-by-side spaced elements defining a grate unit having a plurality of spaced passages therethrough, said air blocking means comprising a sheet of synthetic resin material normally disposed against the grate unit in air blocking relationship to the passages, the sheet material being characterized by the property of substantially moving out of blocking relationship to the passages through the grate unit at said predetermined temperature.

6. A water cooling tower as set forth in claim 1, wherein the fan deck is made up of a series of alternate panels and grate units, each of said grate units comprising a plurality of elongated, side-by-side spaced elements presenting a plurality of spaced passages therebetween, said air blocking means comprising a sheet of synthetic resin material disposed against each of the grate units in air blocking relationship to the passage therethrough, each of the sheets of synthetic resin material being characterized by the property of substantially moving out of blocking relationship to corresponding passages through respective grate units when the temperature of the air proximal thereto rises to said predetermined temperature.

7. A water cooling tower as set forth in claim 1, wherein said aperture means comprises a series of spaced elements defining a passage between each adjacent pair of elements, and a sheet member in normal covering relationship to the passages between said elements to block flow of air therethrough, said sheet member being fabricated of material that is sufficiently heat sensitive to substantially burn away at said predetermined temperature.

8. A water cooling tower as set forth in claim 7, wherein said sheet member is of nylon.

9. A water cooling tower as set forth in claim 7, wherein said sheet member is of polyethylene.

10. A water cooling tower as set forth in claim 9, wherein said polyethylene is reinforced with nylon.

11. A water cooling tower as set forth in claim 9, wherein said polyethylene sheet member is of a thickness from about 5 to about 100 mils.

12. A water cooling tower as set forth in claim 1, wherein said air blocking means is a synthetic resin sheet material which at least softens sufficiently at said predetermined temperature to allow the sheet material to move out of blocking relationship to the passage as a result of the pressure of air flowing through the interior of the enclosure from the entrance of the enclosure to the heated air outlet therein.

13. A water cooling tower as set forth in claim 12, wherein said material substantially liquefies at said predetermined temperature.

14. A water cooling tower as set forth in claim 1, wherein one of said enclosure defining members includes a series of elongated, side-by-side, spaced elements defining a grate unit having a plurality of spaced passages therethrough, said air blocking means comprising a sheet of synthetic resin material normally disposed against the grate unit in air blocking relationship to the passages, the sheet material being characterized by the property of substantially moving out of blocking relationship to the passages through the grate unit at said predetermined temperature.

15. A water cooling tower as set forth in claim 14, wherein said grate unit includes a series of spaced elements joined by a plurality of cross connectors extending transversely thereof.

16. A water cooling tower as set forth in claim 14, wherein a pair of grate units are provided in juxtaposed, stacked relationship, said synthetic resin sheet material being interposed between the grate units in normal blocking relationship to air flow therethrough.

17. A water cooling tower as set forth in claim 1, wherein at least one of the enclosure members is provided with an opening therein adjacent the zone of juncture of casing and fan deck members, and a sheet member in normal closing relationship to said opening, said sheet member being of a material which burns and at least softens sufficiently at said predetermined temperature to allow the sheet material to move out of blocking relationship to the opening.

18. A water cooling tower as set forth in claim 17, wherein said material substantially liquefies at said predetermined temperature.

19. A water cooling tower as set forth in claim 1, wherein said fill assembly is made up of a plurality of individual packs of film fill sheets presenting a fill stack, said packs being located in side-by-side relationship in the stack thereof, said structural components including means for supporting the fill pack stack in a manner such that upon ignition of individual packs as a result of a fire within the interior of the tower, the packs undergoing burning may ultimately gravitate away from the remainder of the stack and fall toward the water basin therebelow when the burning pack has been consumed to an extent that it is no longer effectively carried by the support means therefor.

20. A water cooling tower as set forth in claim 19, wherein said means for supporting the fill stack comprises support elements extending through the uppermost parts of the fill packs and which are the sole vertical support for the packs.

* * * * *